US011502457B2

(12) United States Patent
Ando et al.

(10) Patent No.: US 11,502,457 B2
(45) Date of Patent: Nov. 15, 2022

(54) SUBSTRATE PROTECTION STRUCTURE DURING INNER HOUSING ASSEMBLING

(71) Applicant: Yazaki Corporation, Tokyo (JP)

(72) Inventors: Ryota Ando, Shizuoka (JP); Hinata Hayashi, Shizuoka (JP)

(73) Assignee: YAZAKI CORPORATION, Minato-ku (JP)

( * ) Notice: Subject to any disclaimer, the term of this patent is extended or adjusted under 35 U.S.C. 154(b) by 0 days.

(21) Appl. No.: 17/405,319

(22) Filed: Aug. 18, 2021

(65) Prior Publication Data

US 2022/0059969 A1 Feb. 24, 2022

(30) Foreign Application Priority Data

Aug. 21, 2020 (JP) ..... JP2020-139825

(51) Int. Cl.

| | |
|---|---|
| ***H01R 13/629*** | (2006.01) |
| ***H01R 13/64*** | (2006.01) |
| ***H01R 13/66*** | (2006.01) |
| ***H01R 13/504*** | (2006.01) |
| ***H01R 13/52*** | (2006.01) |
| ***H01R 13/639*** | (2006.01) |

(52) U.S. Cl.

CPC ..... *H01R 13/64* (2013.01); *H01R 13/5045* (2013.01); *H01R 13/5213* (2013.01); *H01R 13/629* (2013.01); *H01R 13/639* (2013.01); *H01R 13/66* (2013.01)

(58) Field of Classification Search

CPC ..... H01R 13/64; H01R 13/5045; H01R 13/5213; H01R 13/629; H01R 13/639; H01R 13/66; H01R 13/514; H01R 12/716

See application file for complete search history.

(56) References Cited

U.S. PATENT DOCUMENTS 10,158,190 B1 * 12/2018 Sun ..... H01R 13/405
10,651,614 B1 * 5/2020 Sun ..... H01R 13/514

FOREIGN PATENT DOCUMENTS

JP 2016-213084 A 12/2016
JP 2018-113840 A 7/2018

* cited by examiner

*Primary Examiner* — Tho D Ta
(74) *Attorney, Agent, or Firm* — Sughrue Mion, PLLC

(57) ABSTRACT

A substrate protection structure during inner housing assembling includes an outer housing, a substrate, an inner housing that is disposed with the substrate and is disposed in the outer housing by moving in a predetermined direction relative to the outer housing together with the substrate, and a first projecting portion that is disposed to the inner housing, and projects further on a rear side than the substrate in the predetermined direction when the inner housing is disposed in the outer housing.

3 Claims, 8 Drawing Sheets

SUBSTRATE PROTECTION STRUCTURE DURING INNER HOUSING ASSEMBLING

CROSS REFERENCE TO RELATED APPLICATION

The present application is based on, and claims priority from the prior Japanese Patent Application No. 2020-139825 filed on Aug. 21, 2020, the entire contents of which are incorporated herein by reference.

TECHNICAL FIELD

The present application relates to a substrate protection structure during inner housing assembling.

BACKGROUND

JP 2016-213084 A discloses a substrate built-in connector that includes an outer housing, an inner housing, a terminal, and a substrate. In this substrate built-in connector, the substrate is soldered to the terminal that is press-fitted into the inner housing. Then, the inner housing disposed with the terminal and the substrate is assembled to the outer housing.

SUMMARY

However, in the substrate built-in connector disclosed in JP 2016-213084 A, if a pressing force is directly applied to the substrate when the inner housing is pushed into the outer housing, the stress is given to the substrate. Accordingly, there is a possibility that a solder portion and a mounting component on the substrate are damaged.

An object of the present application is to provide a substrate protection structure during inner housing assembling capable of assembling an inner housing to an outer housing without stressing a substrate.

A substrate protection structure during inner housing assembling according to an embodiment includes an outer housing, a substrate, an inner housing that is disposed with the substrate and is disposed in the outer housing by moving in a predetermined direction relative to the outer housing together with the substrate, and a first projecting portion that is disposed to the inner housing, and projects further on a rear side than the substrate in the predetermined direction when the inner housing is disposed in the outer housing.

In the substrate protection structure during inner housing assembling, the inner housing may include a second projecting portion, and the second projecting portion may contact the outer housing and may be pressed by the outer housing when the inner housing is disposed in the outer housing, so that the inner housing and the outer housing may be integrated with each other with an energizing force.

In the substrate protection structure during inner housing assembling, the first projecting portion of the inner housing may constitute a guide portion that guides the substrate when the substrate is disposed in the inner housing.

The substrate protection structure during inner housing assembling may include a cover that is disposed to the outer housing and closes an opening of a recessed portion that houses the substrate and the inner housing, and in the substrate protection structure during inner housing assembling, the outer housing may be disposed with the recessed portion, and when the substrate and the inner housing are disposed in the outer housing, the first projecting portion of the inner housing may be pushed by the cover, so that the substrate and the inner housing are disposed in the outer housing, and the cover may be disposed to the outer housing.

According to the above described configuration, it is possible to provide a substrate protection structure during inner housing assembling capable of assembling an inner housing to an outer housing without stressing a substrate.

DETAILED DESCRIPTION

Figure 11:
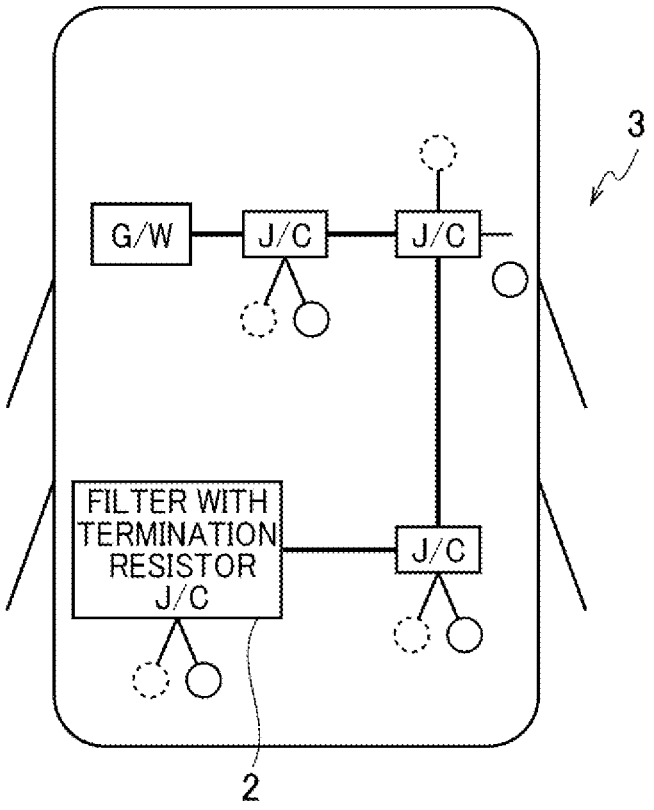
FIG. 11 is a diagram showing one aspect of use of a substrate built-in connector adopted with a substrate protection structure during inner housing assembling according to the present embodiment.
Figure 12:
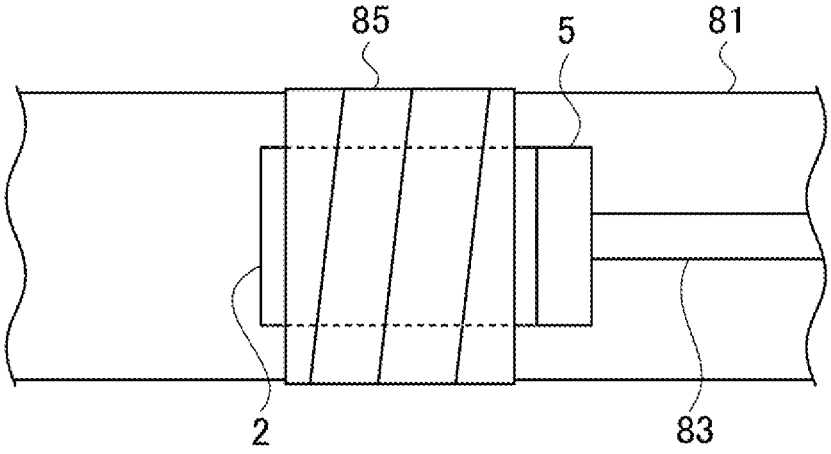
FIG. 12 is a diagram showing one aspect of use of a substrate built-in connector adopted with a substrate protection structure during inner housing assembling according to the present embodiment.

A substrate protection structure 1 during inner housing assembly according to the present embodiment is adopted, for example, in a substrate built-in connector 2. The substrate built-in connector 2 as a filter with a termination resistor in an in-vehicle network (CAN; Controller Area Network) 3 is used by being connected to a mating connector 5. FIG. 11 shows the in-vehicle network 3 and FIG. 12 shows the mating connector 5.

As shown in FIGS. 1 to 8, the substrate built-in connector 2 includes an outer housing 7, a substrate (a circuit substrate) 9, a terminal 11, and an inner housing 13. The substrate built-in connector 2 may be called an electric component to be connected to the mating connector 5.

Here, for convenience of explanation, a predetermined direction in the substrate built-in connector 2 is defined as a vertical direction, a predetermined position direction orthogonal to the vertical direction is defined as a horizontal direction, and a direction orthogonal to the vertical direction and the horizontal direction is defined as a front-rear direction.

The outer housing 7 is integrally molded of, for example, an insulating synthetic resin. The inner housing 13 is also integrally molded of, for example, an insulating synthetic resin. The terminal 11 is made of a conductive material such as metal.

The terminal 11 is integrally disposed in the inner housing 13 by press fitting or the like. The substrate 9 is integrally disposed in the inner housing 13 via the terminal. The inner housing 13 moves in a predetermined direction relative to the outer housing 7 together with the substrate 9 and the terminal 11. Accordingly, the inner housing 13 is integrally disposed in the outer housing 7 with the substrate 9 and the terminal 11.

The inner housing 13 is provided with a first projecting portion 15 projecting further on a rear side in the front-rear direction (a side opposite the side facing the outer housing 7) than the substrate 9 in the predetermined direction (a moving direction) when the inner housing 13 is disposed in the outer housing 7.

That is, the inner housing 13 is positioned on the rear side in the front-rear direction of the outer housing 7 and is separated from the outer housing 7. From this state, the inner housing 13 is moved on a front side in the front-rear direction relative to the outer housing 7. By this movement, the inner housing 13 is integrally disposed in the outer housing 7. Further, the first projecting portion 15 projects further on the rear side in the front-rear direction than the substrate 9 (see FIG. 5 and the like).

Figure 5:
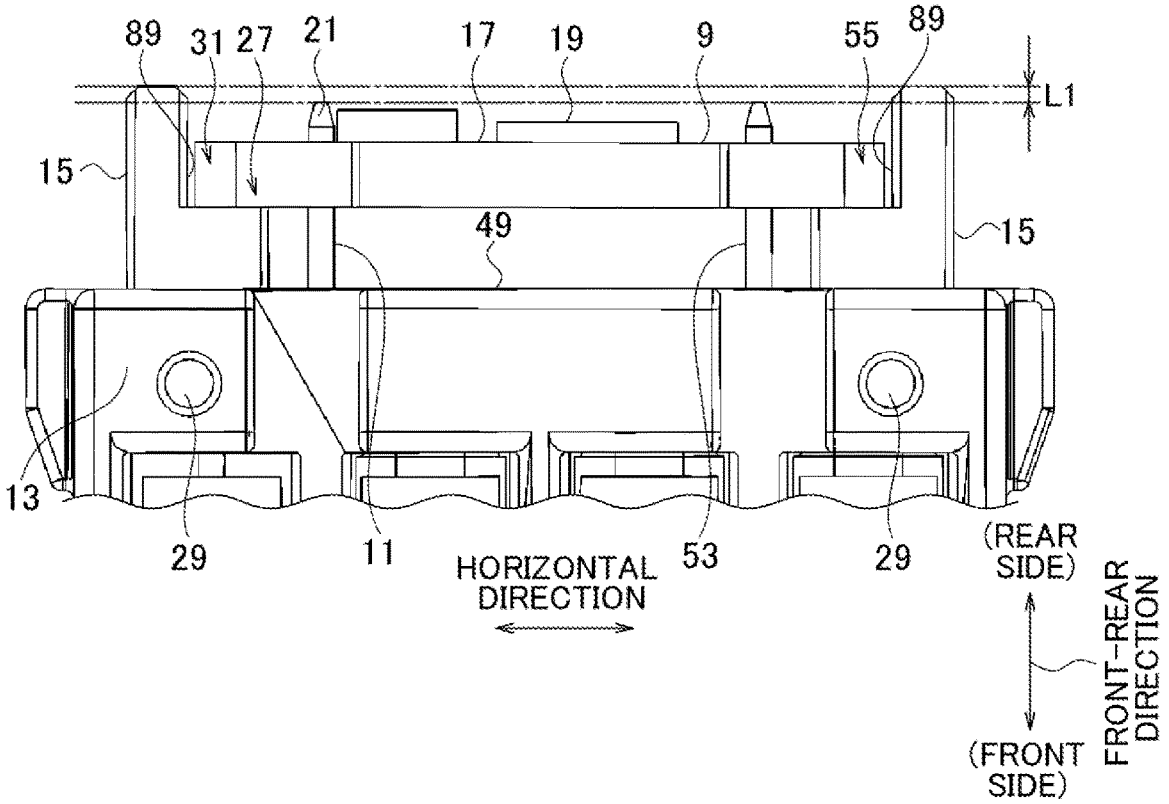
FIG. 5 is a view on an arrow V in FIG. 4.

The substrate 9 includes a substrate body 17, a circuit pattern 71 provided on the substrate body 17, and a circuit component (an electronic component; a mounting component) 19 provided on the substrate body 17. It is generally considered that the terminal 11 is not included in the substrate 9. However, in the present application, a portion 21 of the terminal 11 slightly projecting from the substrate body 17 is also included in the substrate 9. As shown in FIG. 5 and the like, the portion 21 of the terminal 11 slightly projecting from the substrate body 17 is a portion projecting on the rear side in the front-rear direction from the substrate 9.

Among portions of the substrate 9, the portion 21 projects the most on the rear side in the front-rear direction. However, there is a case where the substrate 9 is provided with a portion projecting further on the rear side in the front-rear direction than the portion 21. Even in such a case, the first projecting portion 15 projects more on the rear side than the portion which projects further on the rear side in the front-rear direction than the portion 21. For example, in FIG. 5, if the circuit component 19 projects further on the rear side in the front-rear direction than the portion 21, the first projecting portion 15 projects further on the rear side in the front-rear direction than the circuit component 19.

The outer housing 7 is provided with a locking portion (an inner housing locking portion) 23. The inner housing is provided with a locked portion (a lock portion) 25. When the inner housing 13 is disposed in the outer housing 7, the locked portion 25 is locked to the locking portion 23. This can prevent the inner housing 13 from coming off from the outer housing 7.

Figure 4:
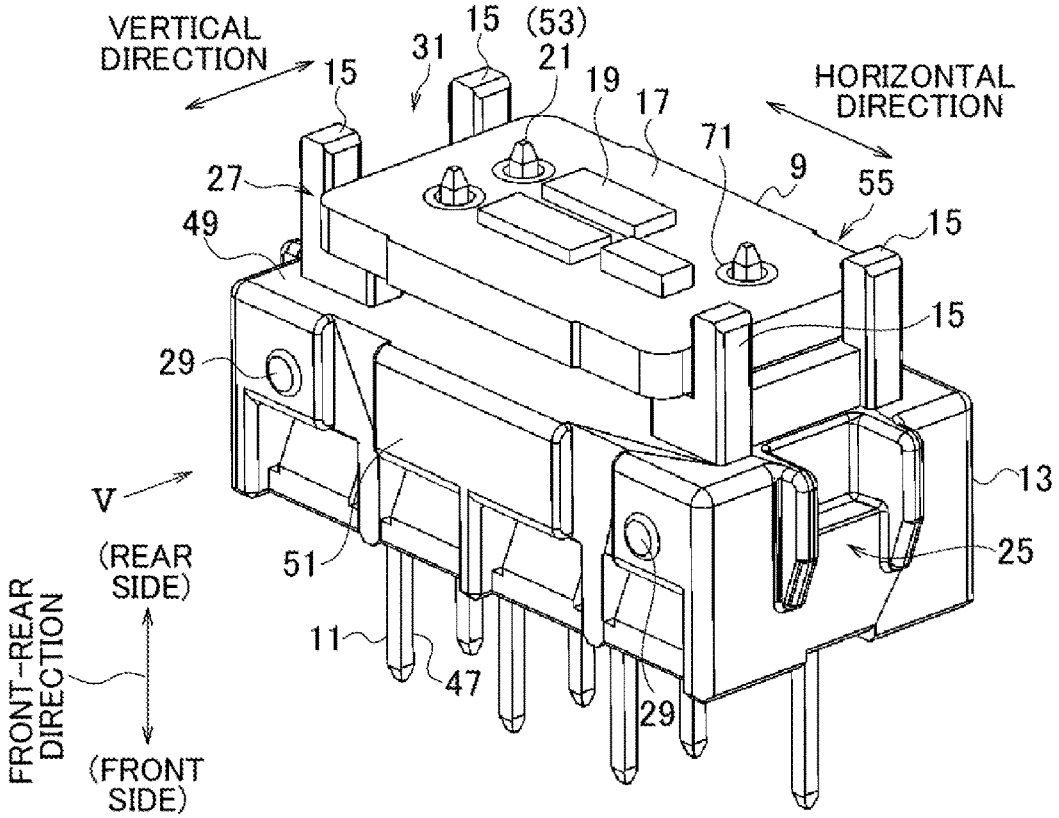
FIG. 4 is a diagram showing a state in which a cover and an outer housing are removed from the substrate built-in connector shown in FIG. 3.

As shown in FIG. 4 and the like, the inner housing 13 includes a substrate disposition portion 27 and a second projecting portion (a press-fit boss) 29. The substrate 9 is disposed in the substrate disposition portion 27 via the terminal 11. The second projecting portion 29 is formed to project in the vertical direction of the inner housing 13 such that the second projecting portion 29 contacts the outer housing 7 and is pressed and deformed when the inner housing 13 is disposed in the outer housing 7.

When the inner housing 13 is disposed in the outer housing 7, the inner housing 13 and the outer housing 7 are integrated with each other without rattling with energizing forces.

The first projecting portion 15 of the inner housing 13 constitutes the guide portion 31 for guiding the substrate 9 when the substrate 9 is disposed in the inner housing 13. That is, the guide portion 31 formed on the horizontal inner side of the first projecting portions 15 positions the substrate 9 relative to the inner housing 13 at least in the horizontal direction. Accordingly, the substrate 9 can be easily disposed at a correct position of the inner housing 13.

Figure 1:
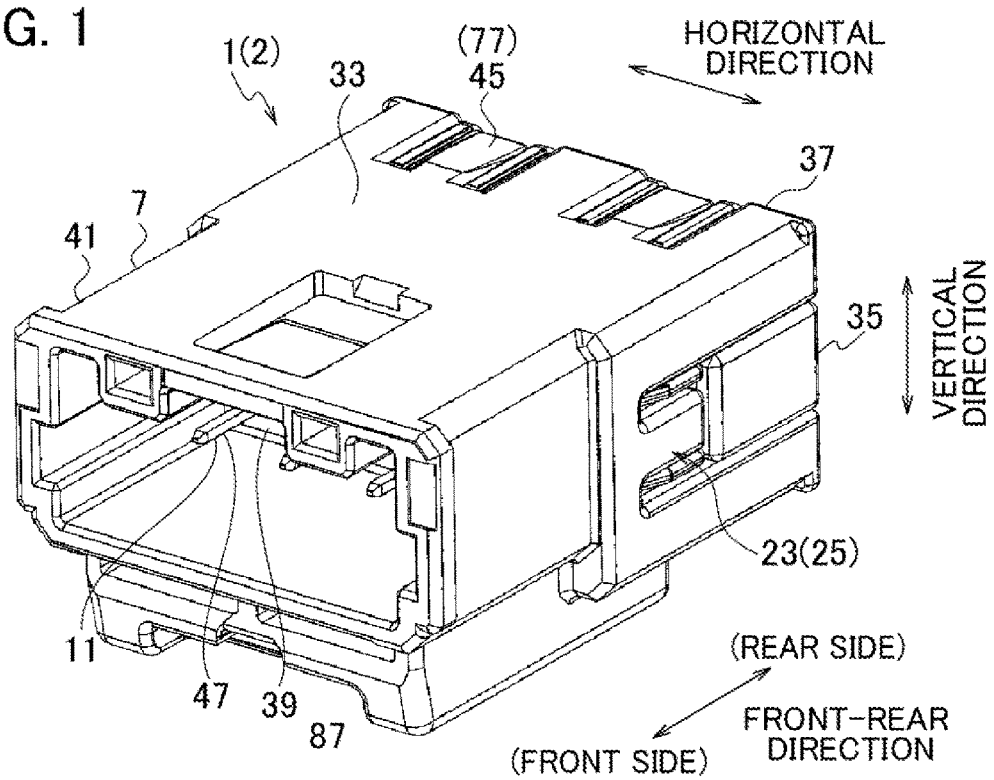
FIG. 1 is a perspective view of a substrate built-in connector adopted with a substrate protection structure during inner housing assembling according to the present embodiment.
Figure 2:
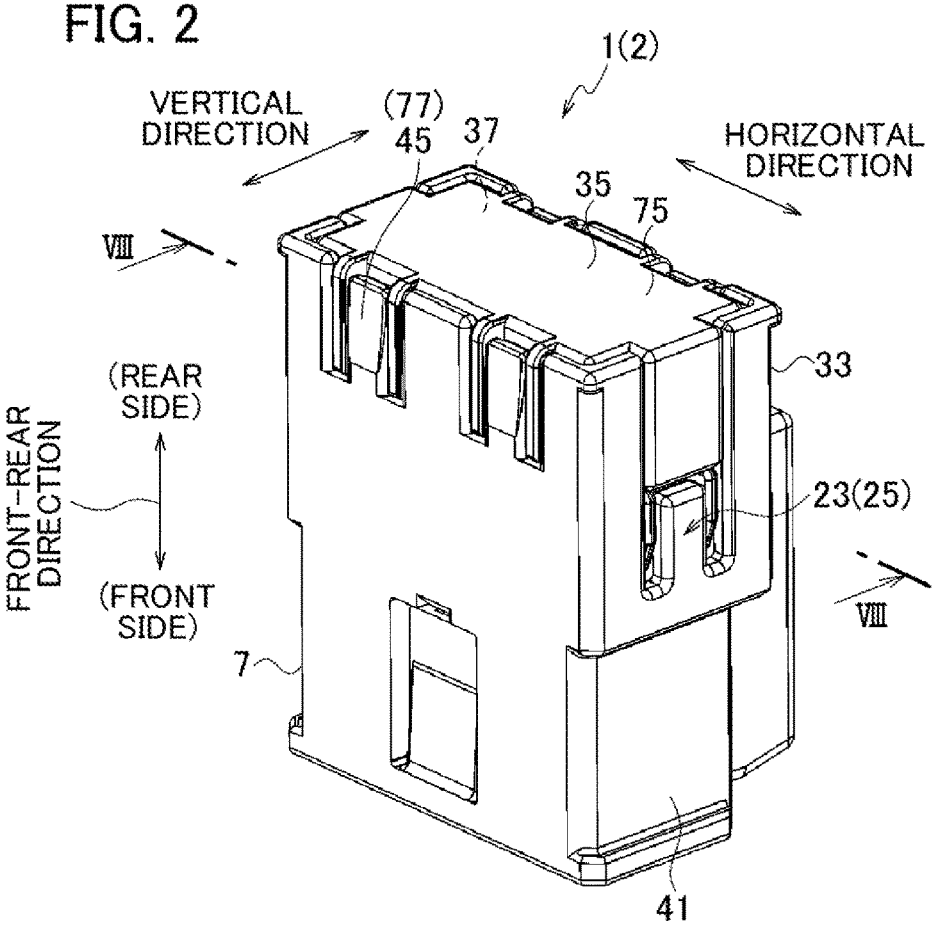
FIG. 2 is a perspective view of a substrate built-in connector adopted with a substrate protection structure during inner housing assembling according to the present embodiment, as viewed from a direction different from FIG. 1.
Figure 3:
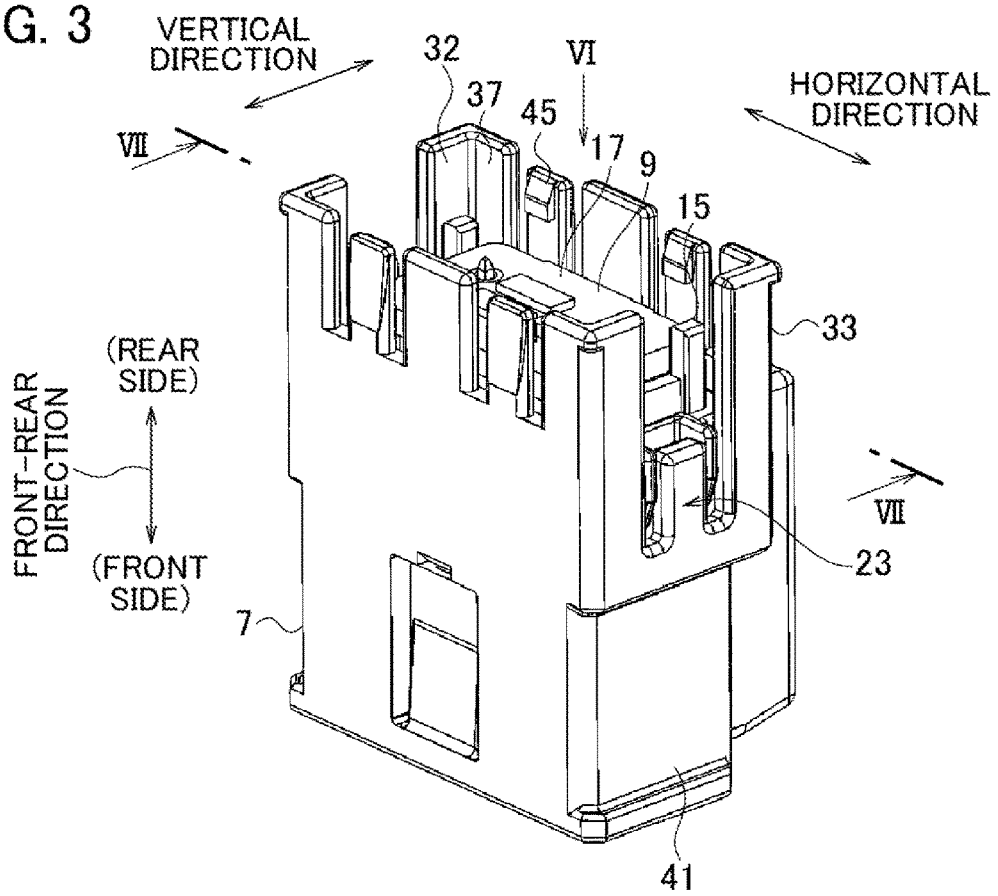
FIG. 3 is a diagram showing a state in which a cover is removed from the substrate built-in connector shown in FIG. 2.

The outer housing 7 is provided with a recessed portion 32 (see FIG. 3, and the like). The recessed portion 32 is formed of a first cylindrical portion 33. When the substrate 9 and the inner housing 13 are disposed in the outer housing 7, the substrate 9 and the inner housing 13 are housed in the first cylindrical portion 33 (the recessed portion 32).

Figure 8:
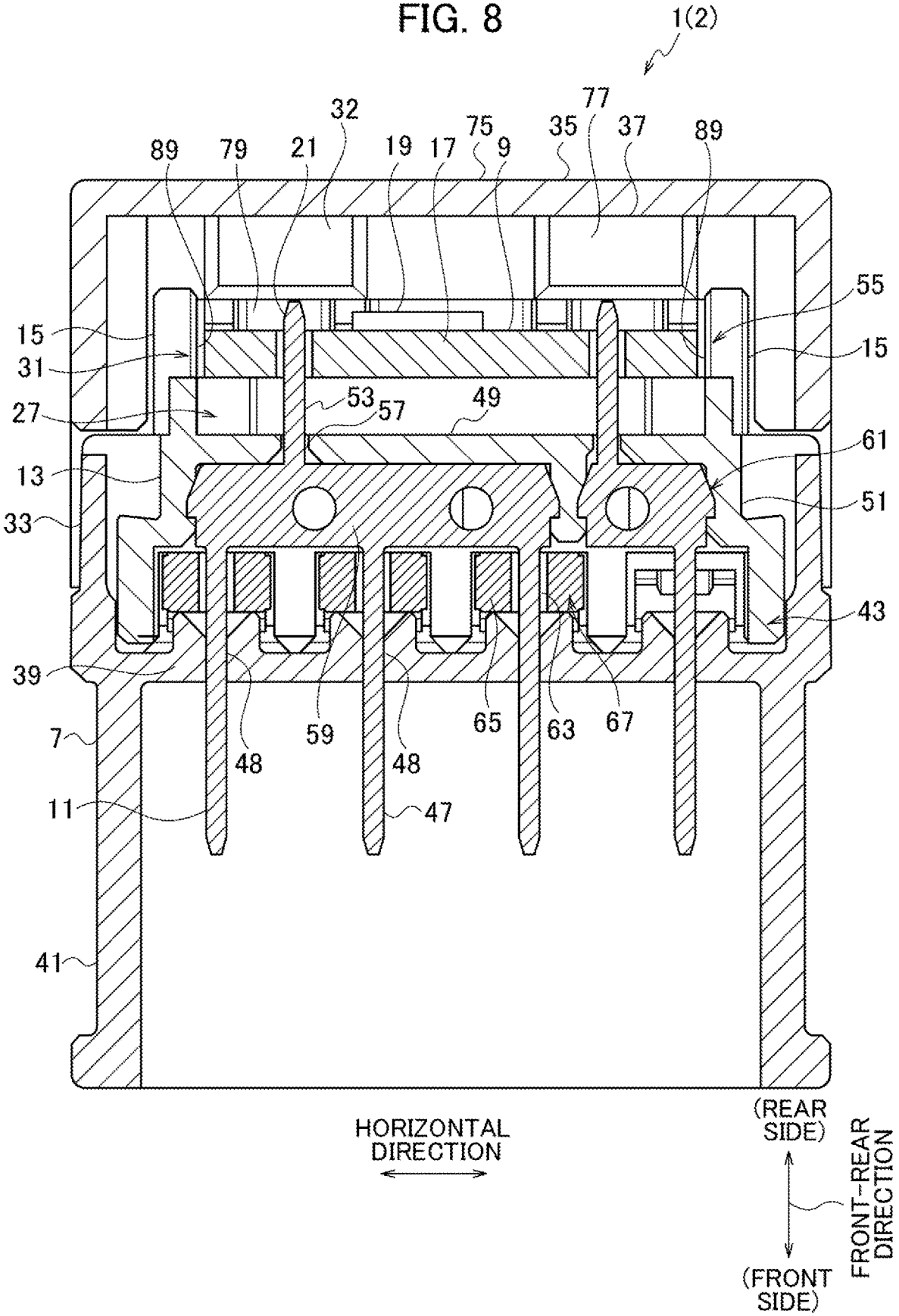
FIG. 8 is a diagram showing the VIII-VIII cross-section in FIG. 2.

As shown in FIG. 8 and the like, the substrate built-in connector 2 is provided with a cover 35. The disposition of the cover 35 in the outer housing 7 closes the opening (a first opening) 37 of the first cylindrical portion 33 (the recessed portion 32). When the substrate 9 and the inner housing 13 are disposed in the outer housing 7 in the substrate built-in connector 2, the first projecting portion 15 of the inner housing 13 may be pressed by the cover 35. The moving direction of the cover 35 at this time is the same as the moving direction of the outer housing 7 when the outer housing 7 is disposed with the inner housing 13 (a direction from a rear side to a front side).

By the substrate 9 and the inner housing 13 being disposed in the outer housing 7, the cover 35 may also be disposed in the outer housing 7. The disposition of the cover 35 in the outer housing 7 causes the substrate 9 and the inner housing 13 to be hidden by the cover 35, and prevents the substrate 9 and the inner housing 13 from being viewed through the first opening 37 of the first cylindrical portion 33.

The substrate built-in connector 2 will now be described in more detail.

Figure 7:
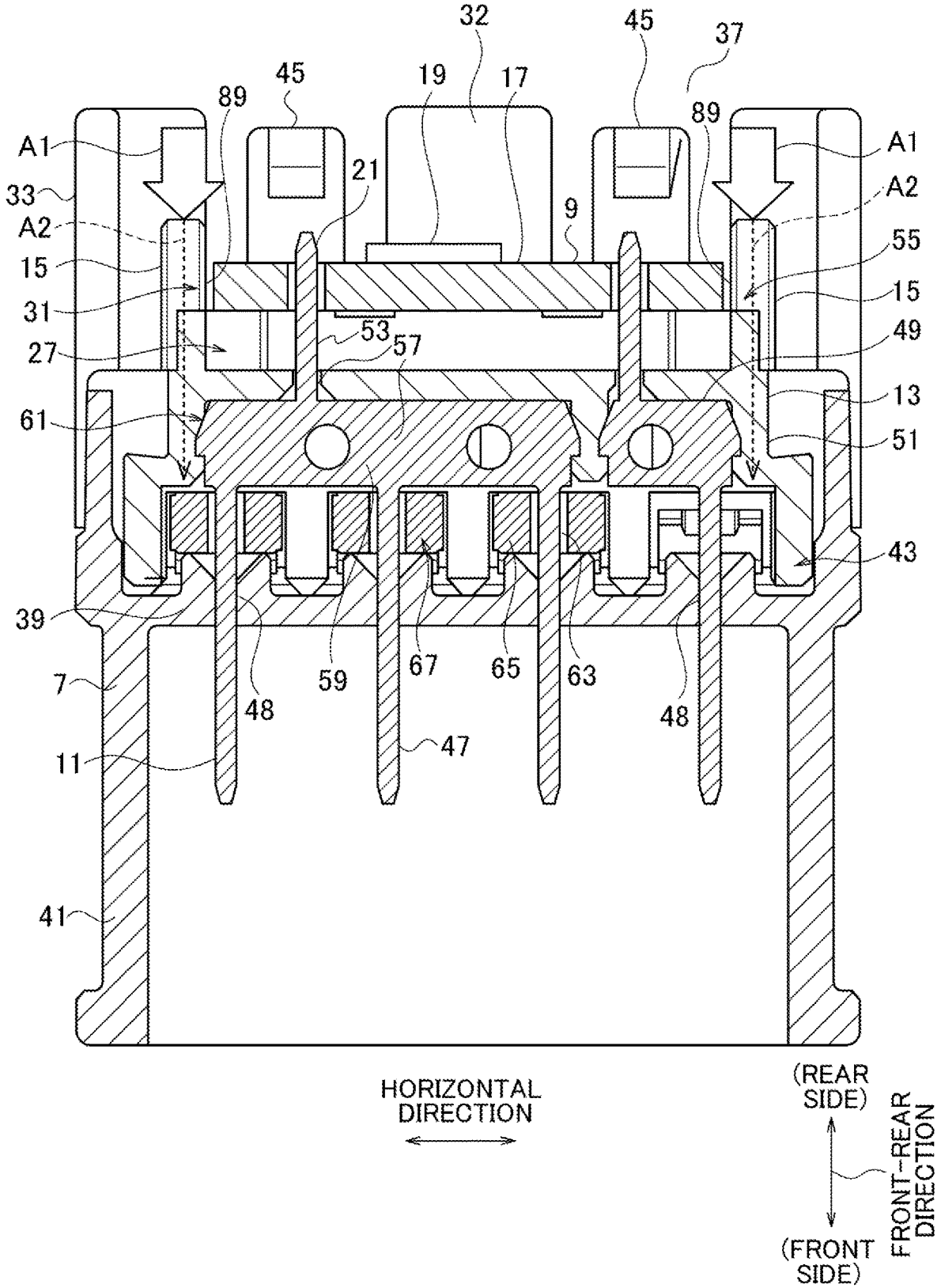
FIG. 7 is a diagram showing the VII-VII cross-section in FIG. 3.

As shown in FIG. 7 and the like, the outer housing 7 includes an outer housing body portion 39, the first cylindrical portion 33, and a second cylindrical portion 41. The first cylindrical portion 33 and the second cylindrical portion 41 are formed in a rectangular cylindrical shape. A central axis of a cylinder of the first cylindrical portion 33 and a central axis of a cylinder of the second cylindrical portion 41 coincide each other.

The central axis of the cylinder of the first cylindrical portion 33 and the central axis of the cylinder of the second cylindrical portion 41 extend in the front-rear direction. The first cylindrical portion 33 projects on the rear side in the front-rear direction from the outer housing body portion 39. Alternatively, the second cylindrical portion 41 projects on the front side in the front-rear direction from the outer housing body portion 39.

The outer housing body portion 39 is formed, for example, in a flat plate shape, and a thickness direction thereof is the front-rear direction. The outer housing body portion 39 is positioned between the first cylindrical portion 33 and the second cylindrical portion 41 in the front-rear direction. Therefore, the outer housing body portion 39 separates a space inside the first cylindrical portion 33 and a space inside the second cylindrical portion 41.

The outer housing 7 includes an inner housing disposition portion 43, a locking portion 23, and a cover locking portion 45. Further, the outer housing body portion 39 is provided with a through-hole 48 through which a second tab portion 47 of the terminal 11 penetrates. Details of the terminal 11 will be described later.

As shown in FIG. 4 and the like, the inner housing 13 has a bottom wall portion 49 and a side wall portion 51, and is formed in a generally rectangular box shape. The side wall portion 51 projects on the front side from the bottom wall portion 49. As described above, the inner housing 13 is provided with the first projecting portion 15 and the second projecting portion 29.

A plurality of (for example, four) first projecting portions 15 are provided, which are formed in a columnar shape (for example, a square columnar shape). The first projecting portion 15 projects on the rear side from the bottom wall portion 49. As shown by a dimension L1 in FIG. 5, in the front-rear direction, a position of a rear end (an upper surface) of the first projecting portion 15 is slightly further rearward than a position of a rear end of the substrate 9 (more specifically, the portion 21 of the terminal 11). As described above, the portion 21 of the terminal 11 is a portion of a first tab portion 53 of the terminal 11 that projects more rearward than the substrate 9 (a rear end portion of the first tab portion 53).

Figure 6:
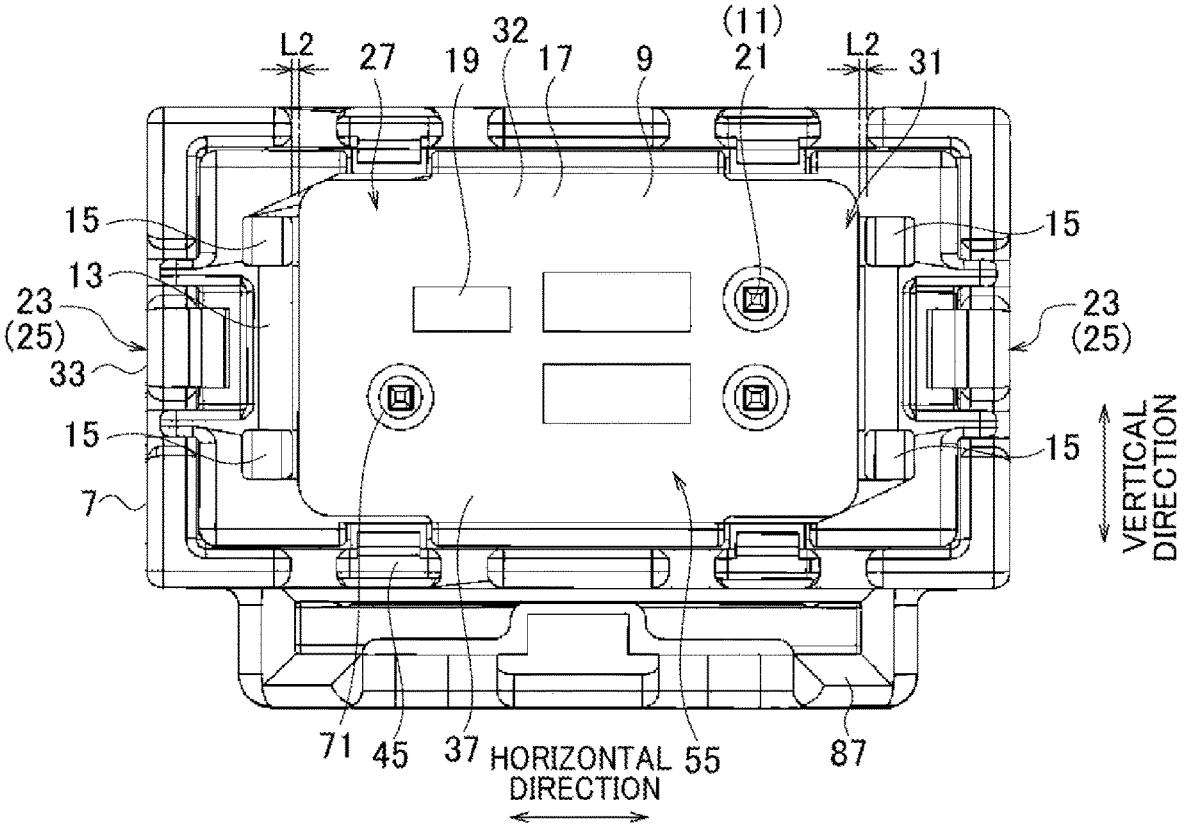
FIG. 6 is a view on an arrow VI in FIG. 3.

When viewed in the front-rear direction, as shown in FIG. 6, the substrate 9 is formed in a rectangular shape. The four first projecting portions 15 are positioned near four corners of the substrate 9 respectively to surround the substrate 9. For example, among four sides (sides constituting the outer periphery) of the rectangular substrate 9, a pair of sides which are parallel to each other extend in the vertical direction. At the outside of each of the pair of sides, the first projecting portion 15 is disposed.

More specifically, the two first projecting portions (the two first projecting portions on the left side in FIG. 6) 15 are disposed outside a first side of the substrate 9. The first side is one of the pair of sides extending in the vertical direction of the substrate 9. These two first projecting portions 15 are separated from each other in the vertical direction. Further, each of the two first projecting portions 15 is positioned near each corner of the rectangular substrate 9.

The other two first projecting portions (the two first projecting portions on the right side in FIG. 6) 15 are disposed outside a second side of the substrate 9. The second side is the other of the pair of sides extending in the vertical direction of the substrate 9. The other two first projecting portions 15 are also separated from each other in the vertical direction. Each of the other two first projecting portions 15 is also positioned near each corner of the rectangular substrate 9.

Further, a value of a distance L2 between the substrate 9 and the first projecting portion 15 in the horizontal direction is very small or "0".

The above described positional relationship between the substrate 9 and the first projecting portion 15 causes the first projecting portion 15 to serve as the guide portion 31 for guiding the substrate when the substrate 9 is disposed in the inner housing 13. That is, the guide portion 31 formed on the horizontal inner side of the first projecting portions 15 positions the substrate 9 relative to the inner housing 13 at least in the horizontal direction when the substrate 9 is disposed in the inner housing 13.

The inner housing 13 is provided with a rectangular parallelepiped substrate support portion 55. The substrate support portion 55 is attached to the first projecting portion 15, and projects on the rear side to the same extent as the first projecting portion 15. The first projecting portion 15 and the rectangular parallelepiped substrate support portion 55 are integrated with each other.

The substrate support portion 55 is closer to a center side of the inner housing 13 than the first projecting portion 15 in the horizontal direction. A value of the projecting height of the substrate support portion 55 from the bottom wall portion 49 is smaller than a value of the projecting height of the first projecting portion 15. When viewed in the vertical direction, the integrally formed first projecting portion 15 and rectangular parallelepiped substrate support portion 55 form an "L" shape.

The thickness direction of the substrate 9 disposed in the inner housing 13 is the vertical direction in the diagram. One of the surfaces in the thickness direction (a surface on the front side in the front-rear direction) abuts on an upper surface of the substrate support portion 55 (a surface on the rear side in the front-rear direction). This positions the substrate 9 relative to the inner housing 13 in the front-rear direction.

In the above description, the first projecting portions 15 are disposed outside of the substrate 9 (outside of the four sides) when viewed in the front-rear direction. However, alternatively the first projecting portions 15 may be disposed inside of the substrate 9 (inside of the four sides). For example, the substrate 9 may be provided with through-holes or notches through which the first projecting portions 15 penetrate.

As shown in FIG. 4 or the like, a plurality of second projecting portions 29 (for example, four) are provided, which are formed into a flat plate shape (for example, a disk shape; a short cylindrical shape).

As shown in FIGS. 4 and 5, two of the four second projecting portions 29 on one side of two sides in the vertical direction slightly project in the vertical direction from the side wall portion 51 on the one side. The two second projecting portions 29 are separated from each other in the horizontal direction.

In addition, the other two (not shown in FIGS. 4 and 5) of the four second projecting portions 29 on the other side of the two sides in the vertical direction slightly project from the side wall portion 51 on the other side. The other two second projecting portions 29 are also separated from each other in the horizontal direction.

When the inner housing 13 is disposed in the outer housing 7, the second projecting portion 29 contacts the first cylindrical portion 33 of the outer housing 7 and is pressed and deformed. This integrates the inner housing 13 with the outer housing 7 with each other with energizing force.

As shown in FIG. 7 and the like, the bottom wall portion 49 of the inner housing 13 is provided with a through-hole 57 penetrating a thick portion of the bottom wall portion 49 in the front-rear direction. A portion on the front side of the through-hole 57 is a chain press fitting portion 61 press-fitted with a chain portion 59 of the terminal 11. The first tab portion 53 of the terminal 11 penetrates a portion on the rear side of the through-hole 57. A ferrite disposition portion 67 is provided at a portion on the front side of the chain press fitting portion 61 press-fitted with the chain portion 59 of the terminal 11, the ferrite disposition portion 67 being disposed with a ferrite 65 provided with a through-hole 63.

As shown in FIG. 7 and the like, the terminal 11 includes the chain portion 59, the first tab portion 53, and the second tab portion 47. The chain portion 59 extends long in the horizontal direction. The first tab portion 53 projects on the rear side from the chain portion 59. The second tab portion 47 projects on the front side from the chain portion 59.

In a state where the terminal 11 and the ferrite 65 are disposed in the inner housing 13, the chain portion 59 is press-fitted into the chain press fitting portion 61. Further, in the above state, the first tab portion 53 projects on the rear side from the inner housing 13, and the second tab portion 47 projects on the front side from the inner housing 13. Still further, in the above state, the second tab portion 47 penetrates the through-hole 63 of the ferrite 65, and also projects on the front side from the ferrite 65.

Further, in the substrate built-in connector 2, a front end portion of the second tab portion 47 projects from the outer housing body portion 39 into the second cylindrical portion 41 of the outer housing 7. The insertion of the mating connector 5 into the second cylindrical portion 41 of the substrate built-in connector 2 connects a terminal of the mating connector 5 and the terminal 11 of the substrate built-in connector 2 with each other.

The substrate 9 includes the rectangular plate-shaped substrate body 17, the circuit pattern 71, and the circuit component 19. Further, a portion of the circuit pattern 71 is connected to the front end portion (a rear end portion) of the first tab portion 53 of the terminal 11, and accordingly, the substrate 9 is disposed to the terminal 11.

The cover 35 includes a cover body portion 75 for closing the first opening 37 of the first cylindrical portion 33, and a locked portion 77 to be locked to the cover locking portion 45 of the outer housing 7. When the cover 35 is disposed in the outer housing 7, the locked portion 77 is locked to the cover locking portion 45. This prevents the cover 35 from coming off from the outer housing 7.

As already understood, the substrate 9 is integrally disposed with the inner housing 13 via the terminal 11.

More specifically, as shown in FIG. 8, a closed space 79 is formed from the outer housing 7, the inner housing 13, and the cover 35. The first tab portion 53 of the terminal 11 projects into the closed space 79. The projecting first tab portion 53 is away from the outer housing 7 and the cover 35. The substrate 9 is joined to the first tab portion 53, and is away from the outer housing 7 and the cover 35. Accordingly, even if a force is applied to an outer surface of the substrate built-in connector 2, the force does not reach the substrate 9.

In the substrate built-in connector 2, the outer housing 7 and the inner housing 13 are integrated by being directly joined each other. Further, in the substrate built-in connector 2, the inner housing 13 and the terminal 11 are integrated by being directly joined each other, and the terminal 11 and the substrate 9 are integrated by being directly joined each other.

Next, assembling procedures of the substrate built-in connector 2 will be described with reference to FIGS. 7 to 10C.

Figure 9A:
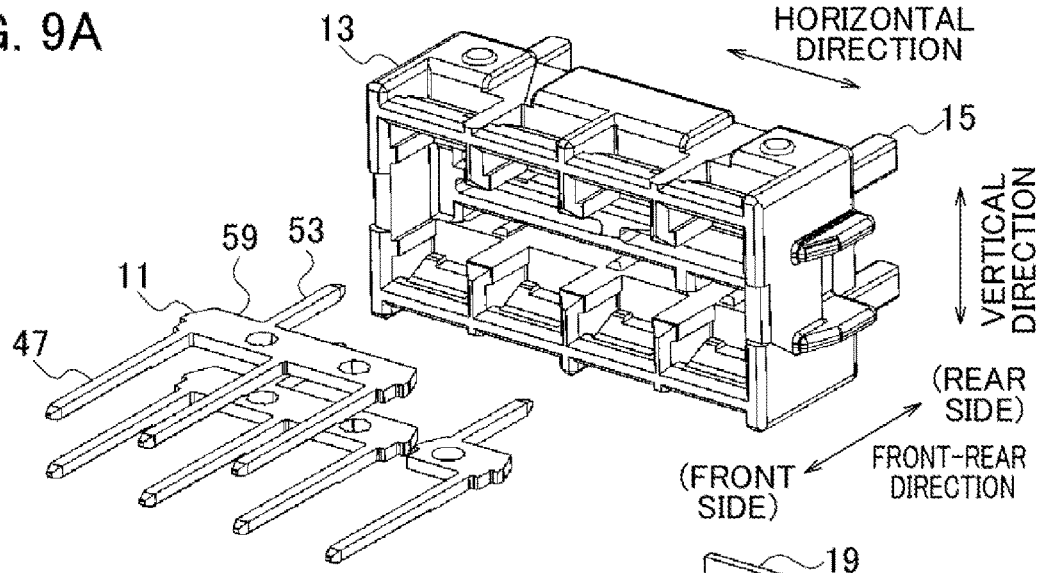
FIGS. 9A, 9B, and 9C are diagrams showing assembling procedures of a substrate built-in connector adopted with a substrate protection structure during inner housing assembling according to the present embodiment.
Figure 9B:
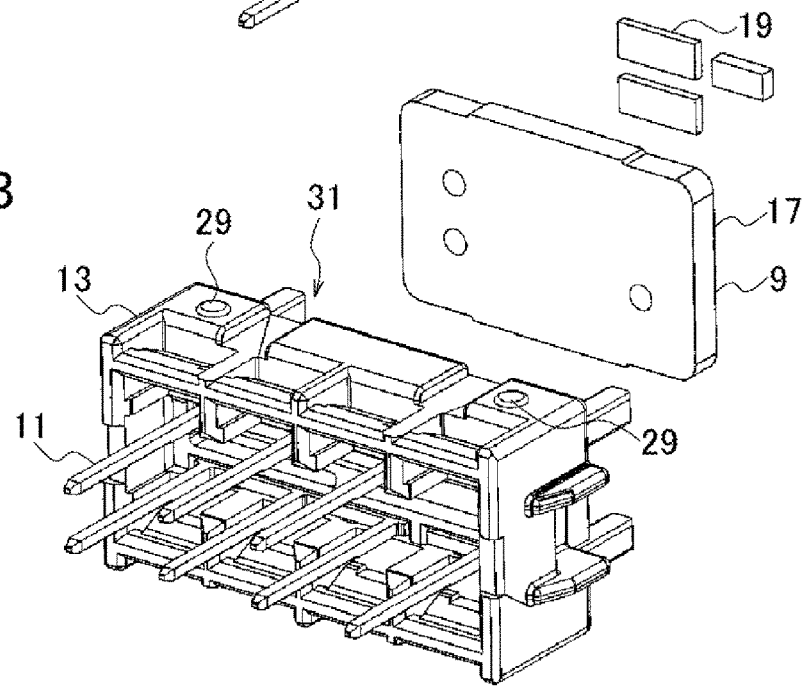
Figure 9C:
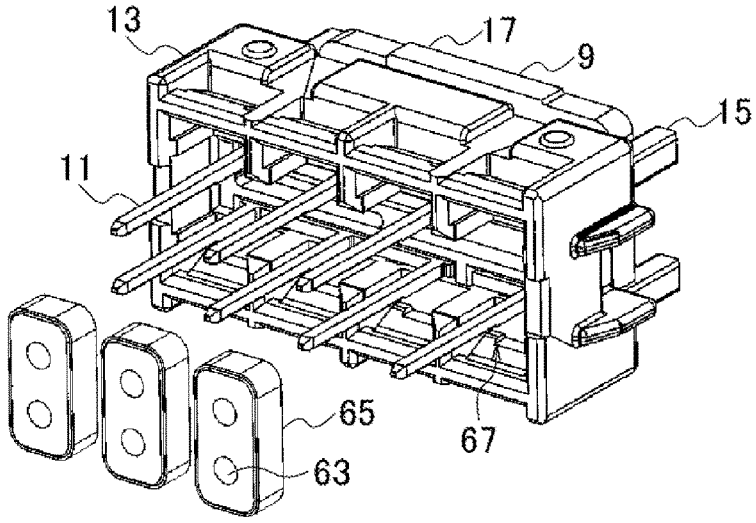

First, as shown in FIG. 9A, the terminal 11 is disposed in the inner housing 13. The terminal 11 is disposed by moving the terminal 11 on the rear side relative to the inner housing 13. Next, as shown in FIG. 9B, the substrate 9 is disposed to the terminal 11. The substrate 9 is disposed by moving the substrate 9 on the front side relative to the terminal 11. Subsequently, as shown in FIG. 9C, the ferrite 65 is disposed in the inner housing 13. The ferrite 65 is disposed by moving the ferrite 65 on the rear side relative to the inner housing 13.

Figure 10A:
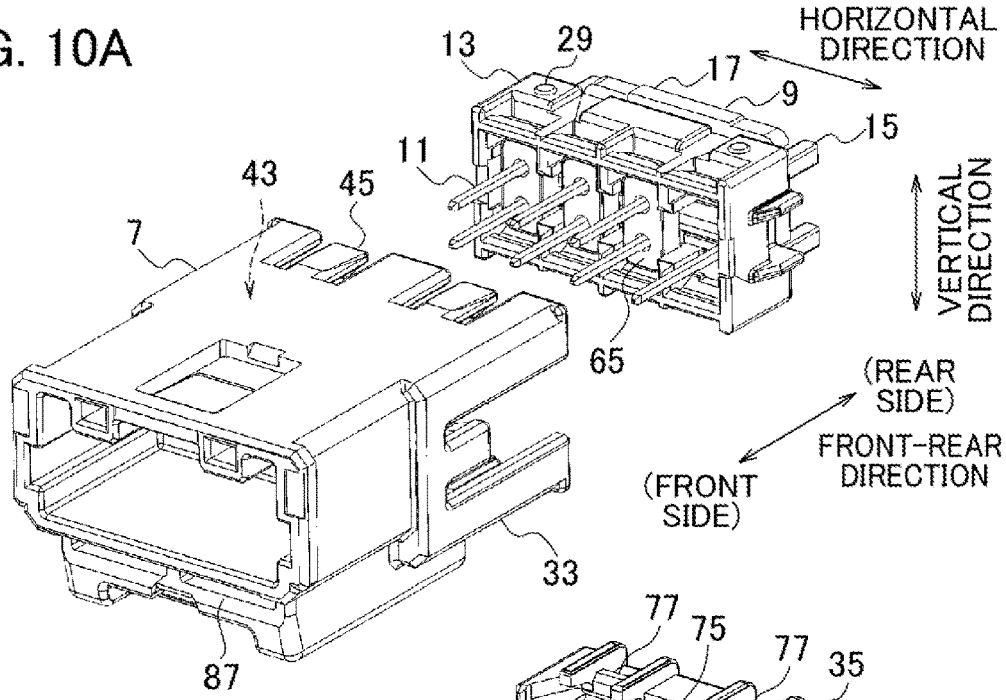
FIGS. 10A, 10B, and 10C are diagrams showing assembling procedures of a substrate built-in connector adopted with a substrate protection structure during inner housing assembling according to the present embodiment.

Subsequently, as shown in FIG. 10A, the inner housing 13 (the inner housing 13, the substrate 9, and the ferrite 65) is disposed in the outer housing 7. The inner housing 13 and the like are disposed by moving the inner housing 13 and the like on the front side relative to the outer housing 7.

The disposition of the inner housing 13 in the outer housing 7 will be described in more detail. The inner housing 13 is disposed in the outer housing 7 by applying a force shown by an arrow A1 in FIG. 7 to the first projecting portion 15 of the inner housing 13, for example, by using a jig (not shown). This moves the inner housing 13 in a direction indicated by an arrow A2 in FIG. 7 to dispose the inner housing 13 in the outer housing 7.

Figure 10B:
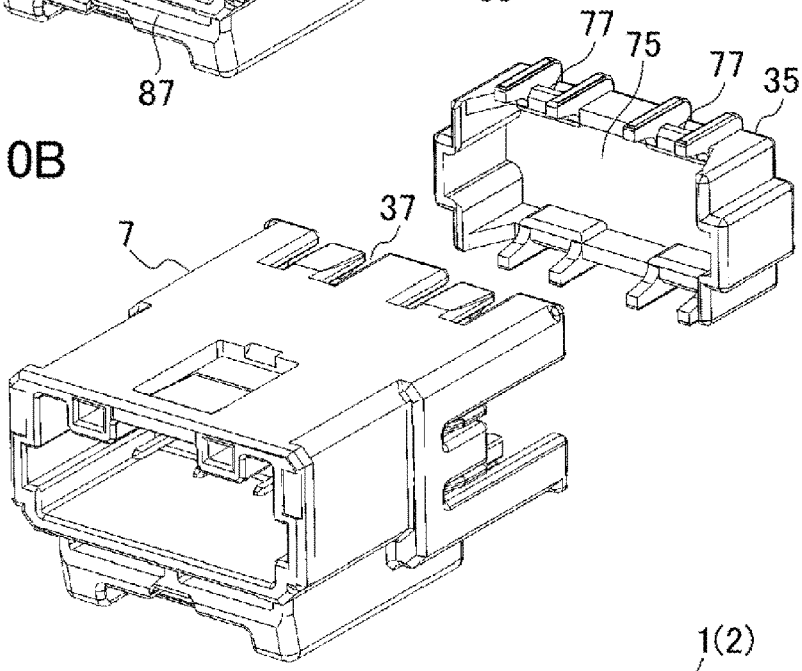
Figure 10C:
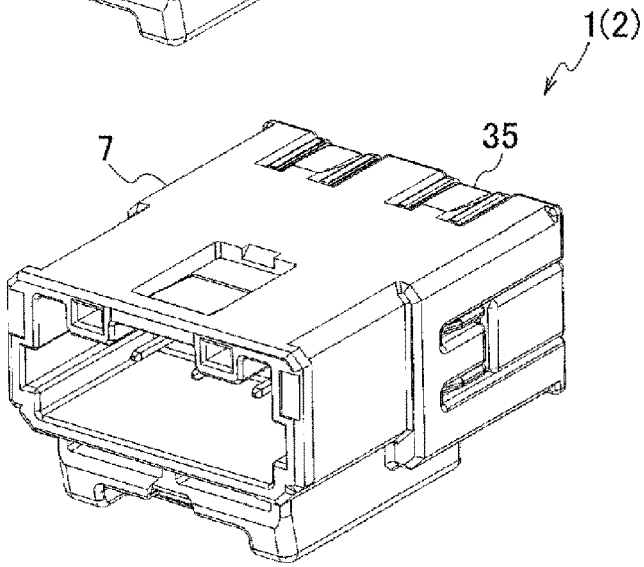

Next, as shown in FIG. 10B, the cover 35 is disposed to the outer housing 7 to form the substrate built-in connector 2 as shown in FIGS. 8 and 10C. The cover 35 is disposed by moving the cover 35 on the front side relative to the outer housing 7.

Next, how to dispose the substrate built-in connector 2 to a wire harness 81 will be described with reference to FIG. 12.

First, the mating connector 5 is disposed to the substrate built-in connector 2. A wiring 83 such as an electric wire extends from the mating connector 5. Then, the substrate built-in connector 2 is disposed to a material to be disposed such as the wire harness 81 by using a substrate built-in connector disposition body such as a tape 85. The substrate built-in connector 2 is disposed to the wire harness 81 by, for example, winding the tape 85 around the wire harness 81, and the substrate built-in connector 2 in contact with the wire harness 81.

The outer housing 7 of the substrate built-in connector 2 is provided with, for example, an outer housing disposition portion 87 (see FIG. 1 and the like) formed in an annular shape (a rectangular cylindrical shape). A string-like disposition member (not shown) is passed through the annular outer housing disposition portion 87, and the above described disposition member is tied or wound around the wire harness 81 to dispose the substrate built-in connector 2 to the wire harness 81.

In the substrate built-in connector 2, the inner housing 13 is moved in the predetermined direction relative to the outer housing 7 together with the substrate 9 and the terminal 11, so that the inner housing 13 is disposed in the outer housing 7. The first projecting portion 15 of the inner housing 13 is projected on the rear side of the substrate 9 in the moving direction of the inner housing 13 at the time of the disposition.

With such the configuration, the inner housing 13 is pushed into the outer housing 7 with a pressing force applied only to a leading end (a top surface; a rear end surface) of the first projecting portion 15. Accordingly, the inner housing 13 can be fitted and assembled into the outer housing 7 without stressing the substrate 9.

Further, the application of the pressing force only to the leading end (the top surface; the rear end surface) of the first projecting portion 15 can prevent the occurrence of a defect such as buckling to the elongated square columnar first tab portion 53 of the terminal 11.

Next, a comparative example will be described. A substrate built-in connector according to the comparative example includes an outer housing, an inner housing, a terminal, and a substrate. In this substrate built-in connector, the terminal is disposed in the inner housing by press fitting, for example. A first end portion as one of end portions of the terminal projects from a first end surface as one of end surfaces of the inner housing. A second end portion as the other of the end portions of the terminal projects from a second end surface as the other of the end surfaces of the inner housing.

The substrate is disposed to the second end portion of the terminal. The inner housing disposed with the terminal and the substrate is disposed in the outer housing. The outer housing has two cylindrical portions. A first cylindrical portion is disposed with the first end portion of the terminal projecting from the inner housing. A second cylindrical portion is disposed with the second end portion of the terminal projecting from the inner housing, and the substrate.

An opening of the second cylindrical portion is closed by a cover disposed in the outer housing. By the insertion of the mating connector into the first cylindrical portion of the substrate built-in connector according to the comparative example, a terminal of the mating connector and a terminal of the substrate built-in connector are connected with each other.

In the substrate built-in connector according to the comparative example, first the substrate is soldered to the terminal press-fitted into the inner housing. Then, the inner housing disposed with the terminal and the substrate is assembled in the outer housing.

The inner housing is provided with a press-fit boss and a lock for fitting into the outer housing. Therefore, the inner housing needs to be pushed into the outer housing when the inner housing is assembled to the outer housing.

If there are conditions such as a condition that a size of the substrate is larger than a size of the inner housing, for example, it is necessary to apply a pressing force directly to the substrate. Further, it is necessary to push the inner housing into the outer housing and fit the inner housing into the outer housing.

However, in the substrate built-in connector according to the comparative example, if the pressing force is directly applied to the substrate when the inner housing is pushed into the outer housing, the stress is given to the substrate. Accordingly, there is a possibility that a solder portion and a mounting component on the substrate are damaged.

In the substrate built-in connector 2 according to the present embodiment, the second projecting portion 29 contacts the outer housing 7, and is pressed and deformed when the inner housing 13 is disposed in the outer housing 7. This integrates the inner housing 13 with the outer housing 7 with each other with energizing force.

The above configuration can further reduce the pressing force (force for pressing the inner housing 13) required when the inner housing 13 is press-fitted into the outer housing 7 than when the second projecting portion 29 is not disposed to the inner housing 13.

In the substrate built-in connector 2, the first projecting portion 15 of the inner housing 13 constitutes the guide portion 31 for guiding the substrate 9 when the substrate 9 is disposed in the inner housing 13. This can prevent the occurrence of defects such as the substrate 9 first contacting the terminal 11 when the substrate 9 is assembled to the inner housing 13. Further, when the substrate 9 is assembled to the inner housing 13, pressing surfaces 89 set on side surfaces of the first projecting portion 15 (see FIGS. 5, 7, and 8) contact side surfaces of the substrate 9. This can position the substrate 9 relative to the inner housing 13.

In the substrate built-in connector 2, as described above, the cover 35 may be moved in the same direction as the inner housing 13 when the inner housing 13 is disposed in the outer housing 7. The first projecting portion 15 of the inner housing 13 may be pushed by the cover 35, and disposed in the outer housing 7 together with the inner housing 13 and the cover 35.

Such the configuration can eliminate the necessity of a dedicated jig when the inner housing 13 is disposed in the outer housing 7, and reduce man-hours required when the inner housing 13 and the cover 35 are disposed in the outer housing 7.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A substrate protection structure during inner housing assembling comprising:

an outer housing;

a substrate;

an inner housing that is disposed with the substrate and is disposed in the outer housing by moving in a predetermined direction relative to the outer housing together with the substrate; and a first projecting portion that is disposed to the inner housing, and projects further on a rear side than the substrate in the predetermined direction when the inner housing is disposed in the outer housing, wherein the first projecting portion of the inner housing constitutes a guide portion that guides the substrate when the substrate is disposed in the inner housing.

2. The substrate protection structure during inner housing assembling according to claim 1, wherein the inner housing comprises a second projecting portion; and the second projecting portion contacts the outer housing and is pressed by the outer housing when the inner housing is disposed in the outer housing, so that the inner housing and the outer housing are integrated with each other with an energizing force.

3. The substrate protection structure during inner housing assembling according to claim 1, comprising:

a cover that is disposed to the outer housing and closes an opening of a recessed portion that houses the substrate and the inner housing, wherein the outer housing is disposed with the recessed portion; and when the substrate and the inner housing are disposed in the outer housing, the first projecting portion of the inner housing is pushed by the cover, so that the substrate and the inner housing are disposed in the outer housing, and the cover is disposed to the outer housing.

* * * * *